US009518791B1

(12) United States Patent
Heizer et al.

(10) Patent No.: US 9,518,791 B1
(45) Date of Patent: Dec. 13, 2016

(54) CARTRIDGE EXTRACTOR

(71) Applicant: Heizer Defense, LLC, Pevely, MO (US)

(72) Inventors: Charles K. Heizer, St. Louis, MO (US); Thomas C. Heizer, St. Louis, MO (US); Hedy H. Gahn, St. Louis, MO (US)

(73) Assignee: Heizer Defense, LLC, Pevely, MO (US)

( * ) Notice: Subject to any disclaimer, the term of this patent is extended or adjusted under 35 U.S.C. 154(b) by 0 days.

(21) Appl. No.: 15/148,064

(22) Filed: May 6, 2016

Related U.S. Application Data

(63) Continuation-in-part of application No. 14/340,537, filed on Jul. 24, 2014, now Pat. No. 9,435,599, and a continuation of application No. 14/949,873, filed on Nov. 23, 2015, now Pat. No. 9,335,110.

(60) Provisional application No. 62/083,187, filed on Nov. 22, 2014.

(51) Int. Cl.

| | |
|---|---|
| ***F41A 15/00*** | (2006.01) |
| ***F41A 15/06*** | (2006.01) |
| ***F41A 19/10*** | (2006.01) |
| ***F42B 5/26*** | (2006.01) |

(52) U.S. Cl.
CPC ..... *F41A 15/06* (2013.01); *F41A 19/10* (2013.01); *F42B 5/26* (2013.01)

(58) Field of Classification Search
CPC ..... F41A 15/00; F41A 15/06; F41A 15/16; F41A 15/02; F41A 15/08
USPC ..... 42/25, 46, 47
See application file for complete search history.

(56) References Cited

U.S. PATENT DOCUMENTS

| | | | | |
|---|---|---|---|---|
| 763,458 | A | 6/1904 | Beach | |
| 1,530,041 | A | 3/1925 | Fearn | |
| 2,354,025 | A * | 7/1944 | Johnson | F41C 3/02 102/342 |
| 2,982,044 | A | 5/1961 | Sefried | |
| 3,715,825 | A * | 2/1973 | Ilmonen | F41A 15/06 42/46 |
| 4,646,458 | A | 3/1987 | Stevens | |
| 5,678,340 | A * | 10/1997 | Moon | F41A 15/14 42/25 |
| 6,397,505 | B1 | 6/2002 | Stratton | |
| 7,257,917 | B1 * | 8/2007 | Garland | F41A 15/00 42/46 |
| 7,380,362 | B2 * | 6/2008 | Curry | F41A 15/14 42/25 |
| 2012/0167427 | A1 | 7/2012 | Zukowski | |

* cited by examiner

*Primary Examiner* — Reginald Tillman, Jr.
(74) *Attorney, Agent, or Firm* — CreatiVenture Law, LLC; Dennis J M Donahue, III

(57) ABSTRACT

In a breech loading firearm, an extractor arm is slidingly arranged within a cavity beneath the barrel. The extractor arm has a retracted position and an extended position. In the retracted position, the extractor arm is constrained from rotating, and in the extended position, the extractor arm has at least one degree of rotational freedom in the cavity without bending. The intermediate portion of the extractor arm is thicker than the distal end such that the second thickness fits within the cavity when the extractor arm is in its retracted position. The reduced thickness at the distal end provides a space between the extractor arm and a wall of the cavity when the extractor arm is in its extended position to provide for the rotation of the extractor arm within the cavity in its extended position. The proximal end of the extractor arm has an angled face.

22 Claims, 14 Drawing Sheets

CARTRIDGE EXTRACTOR

CROSS-REFERENCE TO RELATED APPLICATIONS

This application is a continuation of U.S. patent application Ser. No. 14/949,873 filed on Nov. 23, 2015 which claims priority to U.S. Provisional Patent Application No. 62/083,187 filed on Nov. 22, 2014 and which is a continuation-in-part of U.S. patent application Ser. No. 14/340,537 filed on Jul. 24, 2014, and all priority applications are hereby incorporated by reference.

BACKGROUND OF THE INVENTION

Field of the Invention

The present invention relates to an extractor assembly, and more particularly to an extractor assembly for rimless shells in a barrel assembly of a breech loading firearm.

Related Art

There are many different trigger mechanisms and extractor systems that have been created for various firearms, including breech-loading firearms in which the barrel rotates relative to the frame such as in derringer-style pistols, most revolvers and shotguns, and some hunting rifles.

Extractor mechanisms for removing rimless cartridges from the firing chamber of firearms usually include an extractor element that slides relative to the chamber while it engages with the cartridge. As indicated in U.S. Pat. No. 4,646,458, it is often not possible in small handguns to provide the degree of extractor element movement required to effect full cartridge extraction. According to this known invention, it may be necessary to provide a means for disengaging the extractor element from a partially extracted cartridge to enable the partially withdrawn cartridge to be dumped or manually removed from the firing chamber. In U.S. Pat. No. 3,715,825, an ejector for a long, tapered cartridge has a short travel but requires the ejector arm to bend as it extends out from its guiding groove. This design requires an elastic ejector arm which is flexible and can be inadvertently bent, and the repeated cyclical bending of the arm may result in fatigue or plastic deformation that could cause the arm to break. The present invention provides an alternative solution to the problem associated with such extractors.

The firearms with a rotating barrel have a catch to lock the barrel in the firing position and a release to allow the barrel to rotate into the loading position, and some of these firearms include a secondary latch or other mechanism to ensure that the barrel does not accidentally rotate out of the firing position while the gun is being discharged. For example, U.S. Pat. No. 27,399 discloses a rotatable trigger guard and a bar with a pair of catches which operate together to prevent the accidental rotation of the barrel. The trigger guard is connected to an inner arm that rotates the barrel between the firing and loading positions, and the bar has a catch on one end to latch the breech of the barrel in the firing position and a secondary catch at the opposite end which is latched by a notch in the rotatable trigger guard. In order to rotate the barrel into the loading position, the catch and secondary catch are released, and the trigger guard must then be rotated downwardly so that the inner arm is moved upwardly with the barrel. Another example of a device to prevent the accidental rotation of the barrel is described by U.S. Pat. No. 3,561,149. According to the '149 Patent, a bolt engages a latching recess in the receiver to lock the barrel in the firing position, and the horn of the trigger guard is moved upwardly to unlock the bolt from the latching recess while simultaneously sliding a safety between the hammer and the receiver to prevent an accidental firing. The horn must be moved to its full upward position in order for the trigger to engage a bar that connects to the sear, and without this engagement between the trigger and the bar, it is not possible to cock the hammer for firing. Both of these barrel locking designs are rather complicated because they require the actuation of additional structural elements other than the trigger. Accordingly, it would be beneficial to provide a barrel locking mechanism which engages when the barrel is closed and has a secondary locking mechanism that is actuated by the trigger itself.

There are also devices that use the trigger to unlock the barrel lock, such as described in U.S. Pat. No. 4,662,097, or that prevent the trigger from moving to the firing position by engaging the trigger when the barrel assembly is out of the firing position, such as described in U.S. Pat. No. 5,165,383, but these devices are not a secondary locking mechanism. Additional barrel locking mechanisms are described in U.S. Pat. Nos. 893,465, 1,562,501, 4,156,980, 4,914,845, and 6,655,065.

SUMMARY OF THE INVENTION

In one aspect of the present invention, an extractor assembly for rimless shells is incorporated into the cavity of a barrel assembly of a breech loading firearm in a way that allows the extractor arm to snugly fit in the cavity when it is fully seated therein and to rotate away from the barrel without bending when it extends out from the cavity.

In another aspect of the present invention, a safety pin locks a barrel latch while the firearm discharges a round of ammunition. The barrel latch safety locking mechanism is actuated by the trigger pull.

The aspects of the present invention as summarized above can be used together or may be used apart from each other in various firearms.

Further areas of applicability of the present invention will become apparent from the detailed description provided hereinafter. It should be understood that the detailed description and specific examples, while indicating the preferred embodiment of the invention, are intended for purposes of illustration only and do not limit the scope of the invention.

BRIEF DESCRIPTION OF THE DRAWINGS

The present invention will become more fully understood from the detailed description and the accompanying drawings, wherein.

DETAILED DESCRIPTION OF THE PREFERRED EMBODIMENTS

Figure 1A:
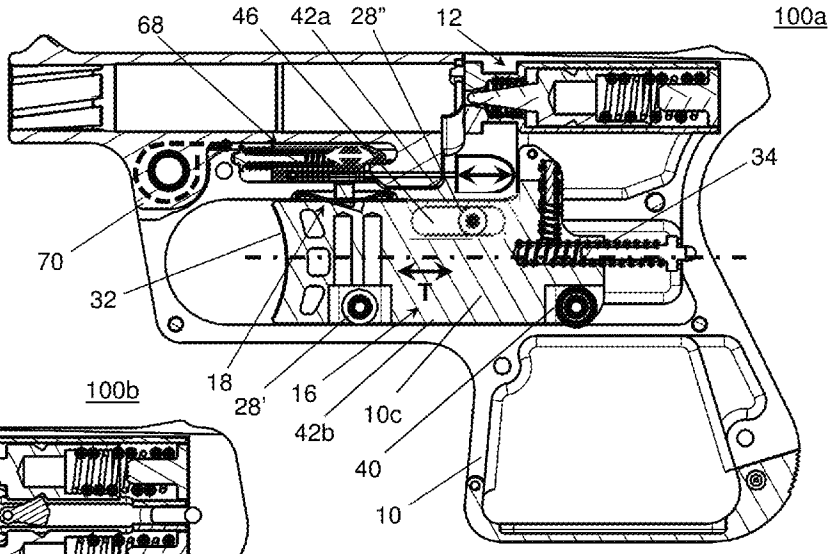
FIGS. 1A and 1B are cross-sectional views of a firearm with the elongated trigger assembly with a roller bearing support and barrel locking mechanism in a single barrel pistol and a double-barrel pistol, respectively.
Figure 1B:
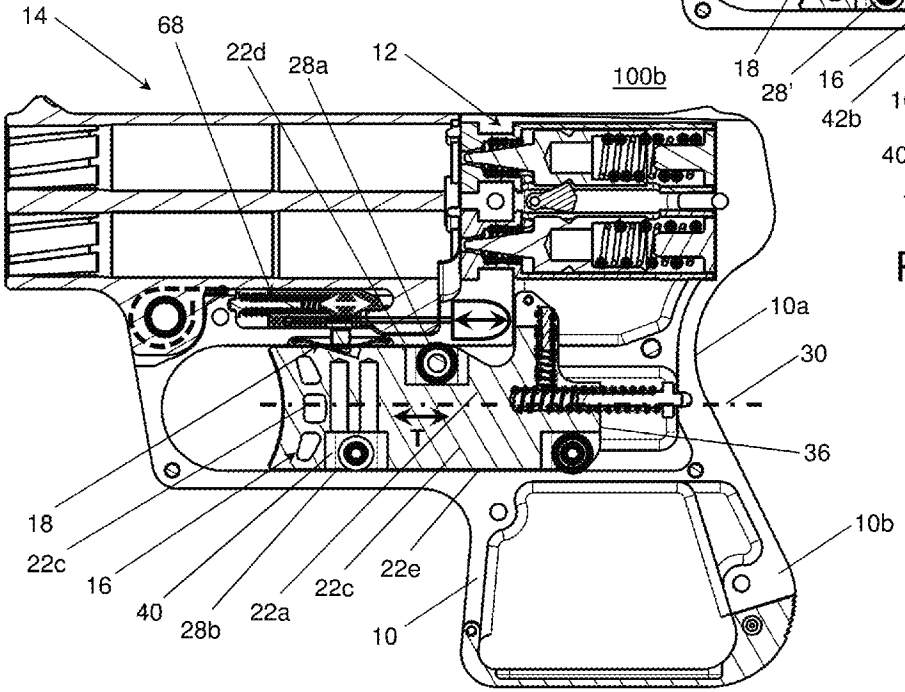

The following description of the preferred embodiment(s) is merely exemplary in nature and is in no way intended to limit the invention, its application, or uses. According to the invention described in detail below and shown in the accompanying drawings, a firearm 100 may have a single barrel configuration 100*a* or a multiple barrel configuration as shown in FIGS. 1A and 1B, respectively. Generally, as shown in FIGS. 1-5, the firearm 100 has a frame 10, a firing assembly 12, a barrel assembly 14, and a trigger assembly 16. The firearm preferably includes a barrel latch safety locking mechanism 18. Additionally, some embodiments of the firearm may have an optional extractor assembly 20, such as shown in FIGS. 3-5.

Elongated Reciprocating Trigger Assembly with Roller Bearings

The trigger assembly 16 of the present invention is fixed within the frame 10 and preferably has an elongated trigger pull 22 that has a length 24 which is longer that the height 26 of the pull. In addition to the elongated trigger pull, the trigger assembly has a roller bearing mechanism 28. The elongated trigger pull has a longitudinal axis 30 that extends between the front of the trigger shoe 32 to the trigger return 34 at the back surface 36 of the trigger pull in the back of the frame which forms the butt end 10*a* and handle 10*b* of the pistol 100. The longitudinal axis is parallel to the reciprocating direction of travel of the trigger pull (T). The roller bearing mechanism has at least one upper roller bearing 28*a* positioned at the top side or within the upper portion 22*a* of the trigger pull above a centerline 22*b* of the trigger pull, and at least one lower roller bearing 28*b* positioned at the bottom side or within the lower portion 22*c* of the trigger pull below the centerline 22*b*. The roller bearing mechanisms 28 engage tracks 38 on which the outer surface of the roller bearings rotate and which constrain the trigger pull to the reciprocating motion. The trigger pull is positioned between the frame's side faces 10*c*.

Figure 2A:
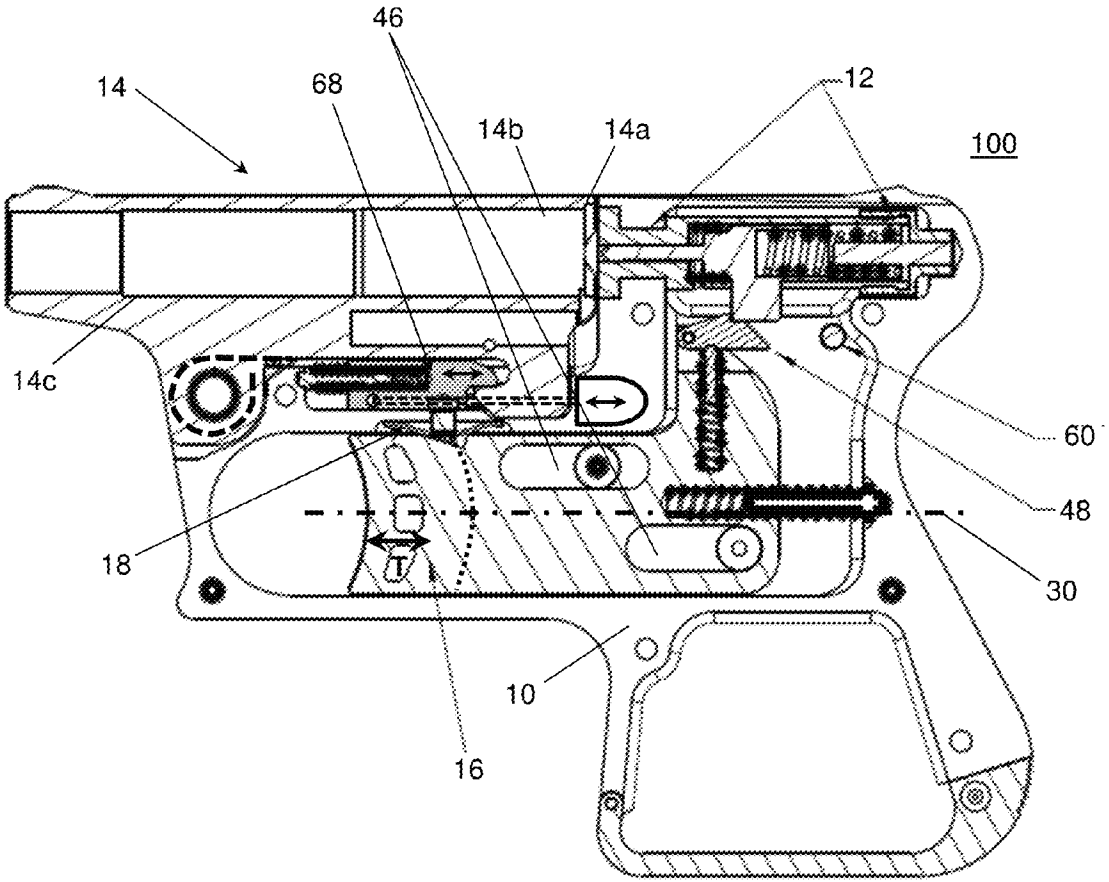
FIGS. 2A and 2B are cross-sectional views of the elongated trigger assembly with an alternative roller bearing support and respectively illustrating the barrel lock safety pin in its disengaged position and engaged position with the barrel locking latch.
Figure 2B:
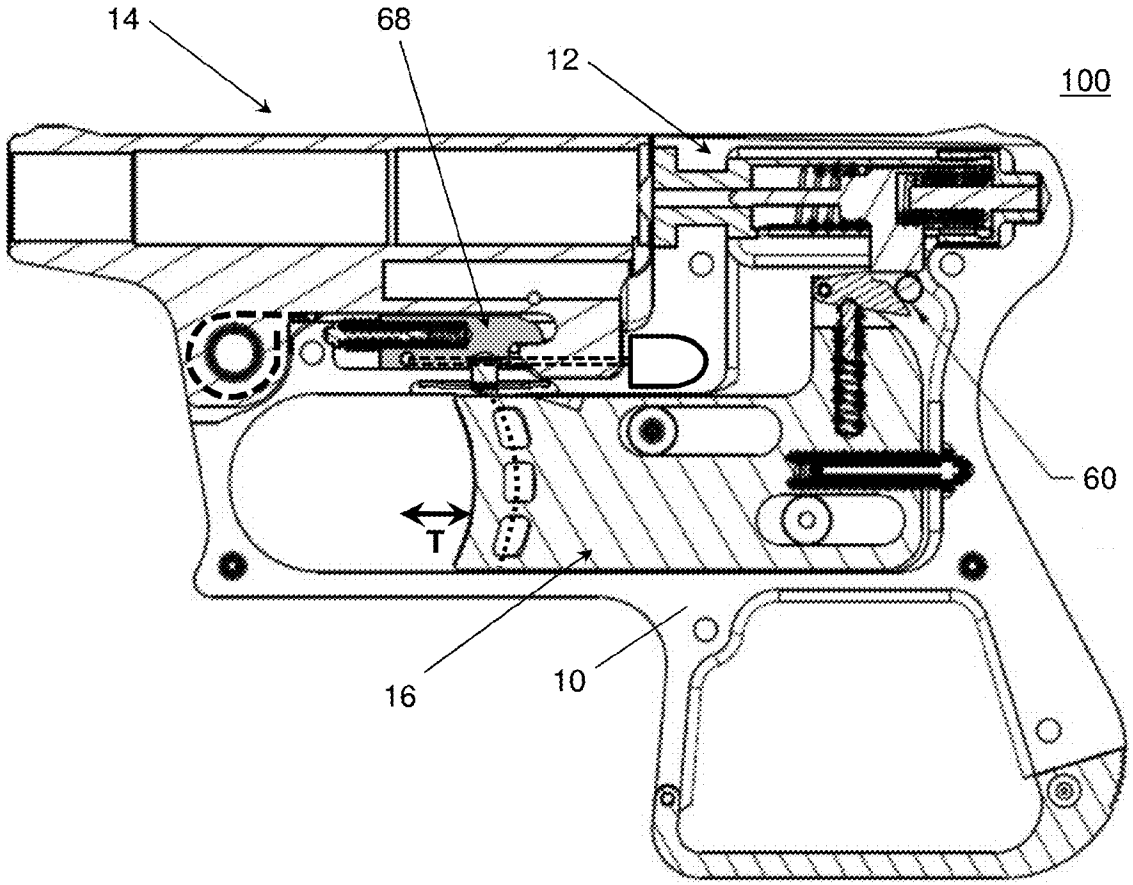
Figure 3A:
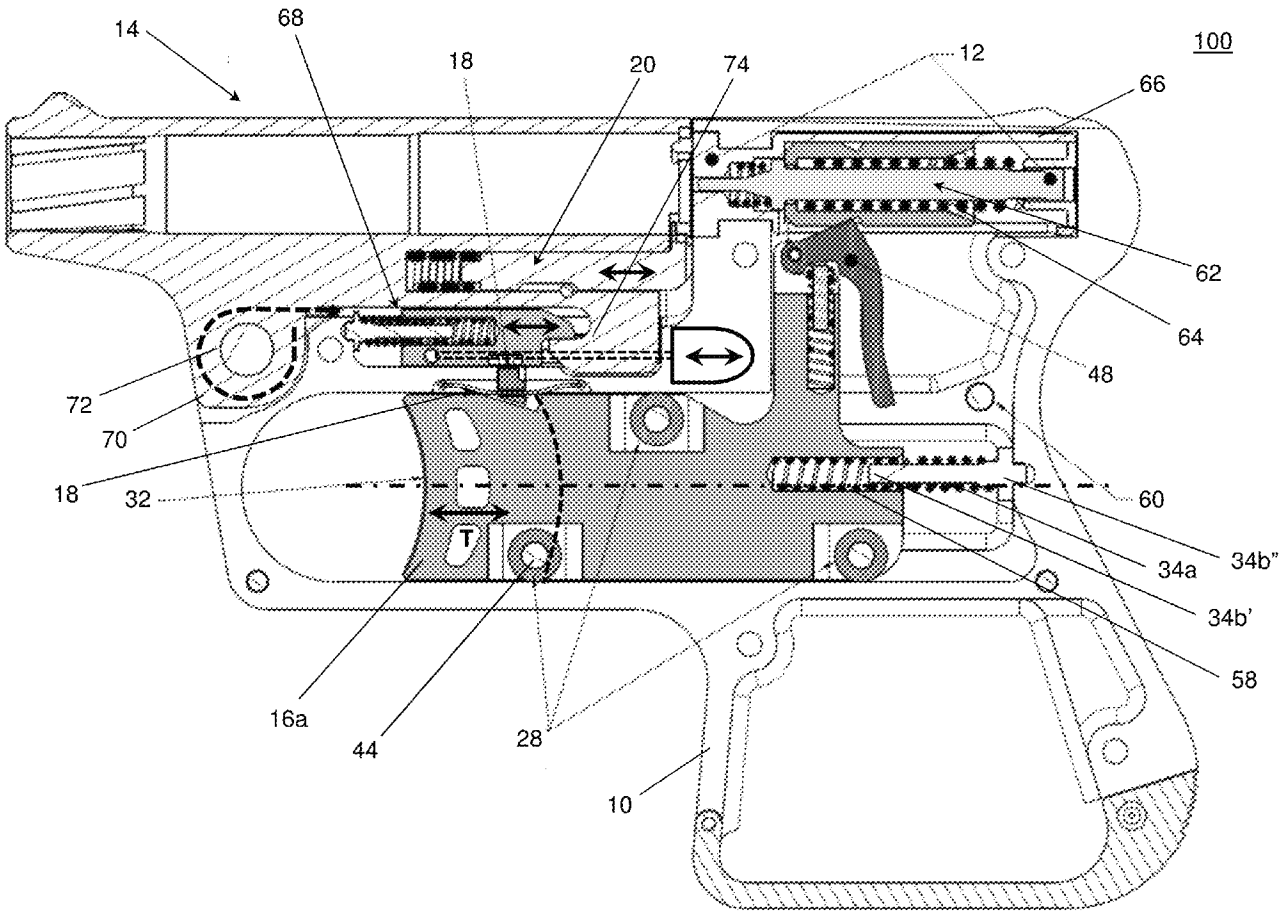
FIGS. 3A-3E are cross-sectional views of the elongated trigger assembly shown in FIG. 1A as the trigger and firing system progress through a firing sequence.
Figure 3B:
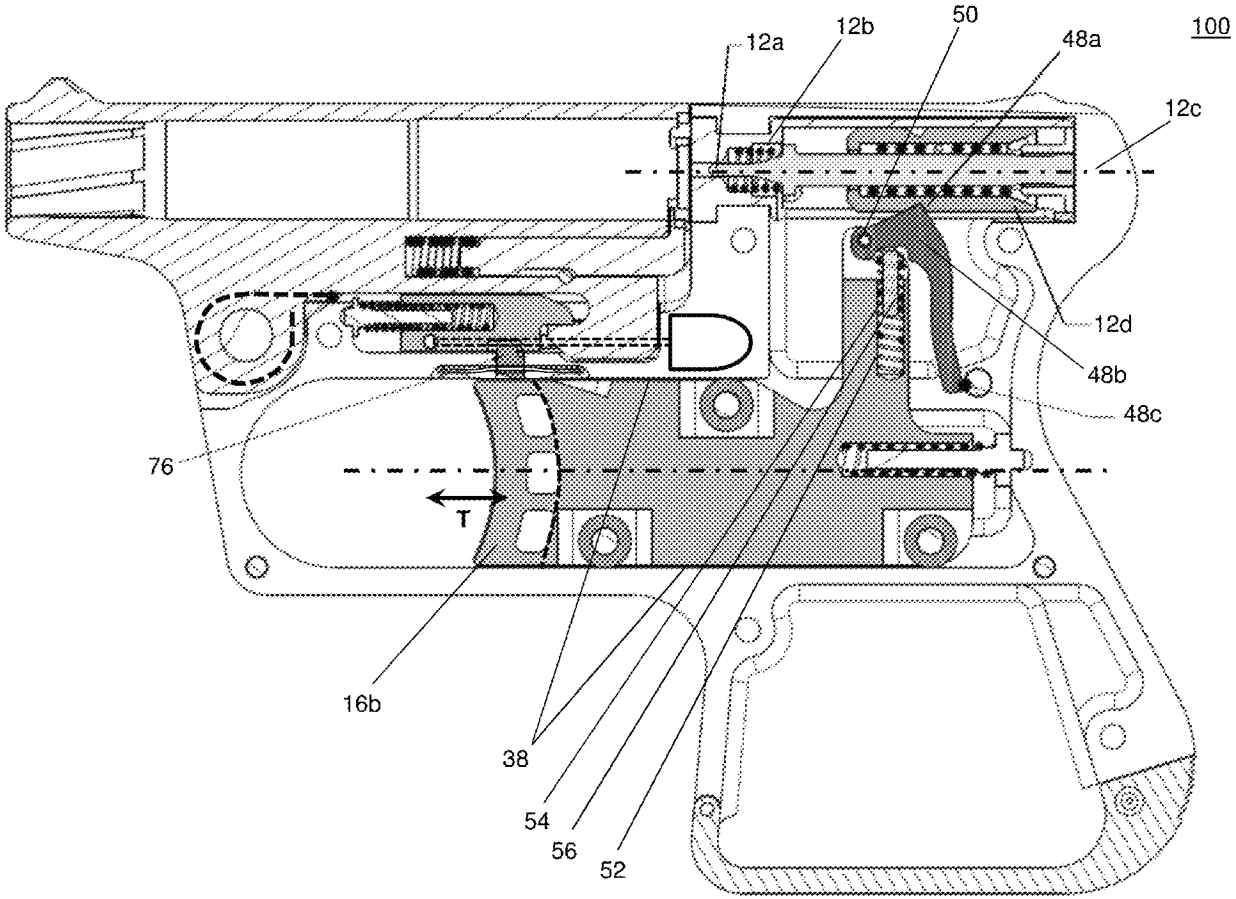
Figure 3C:
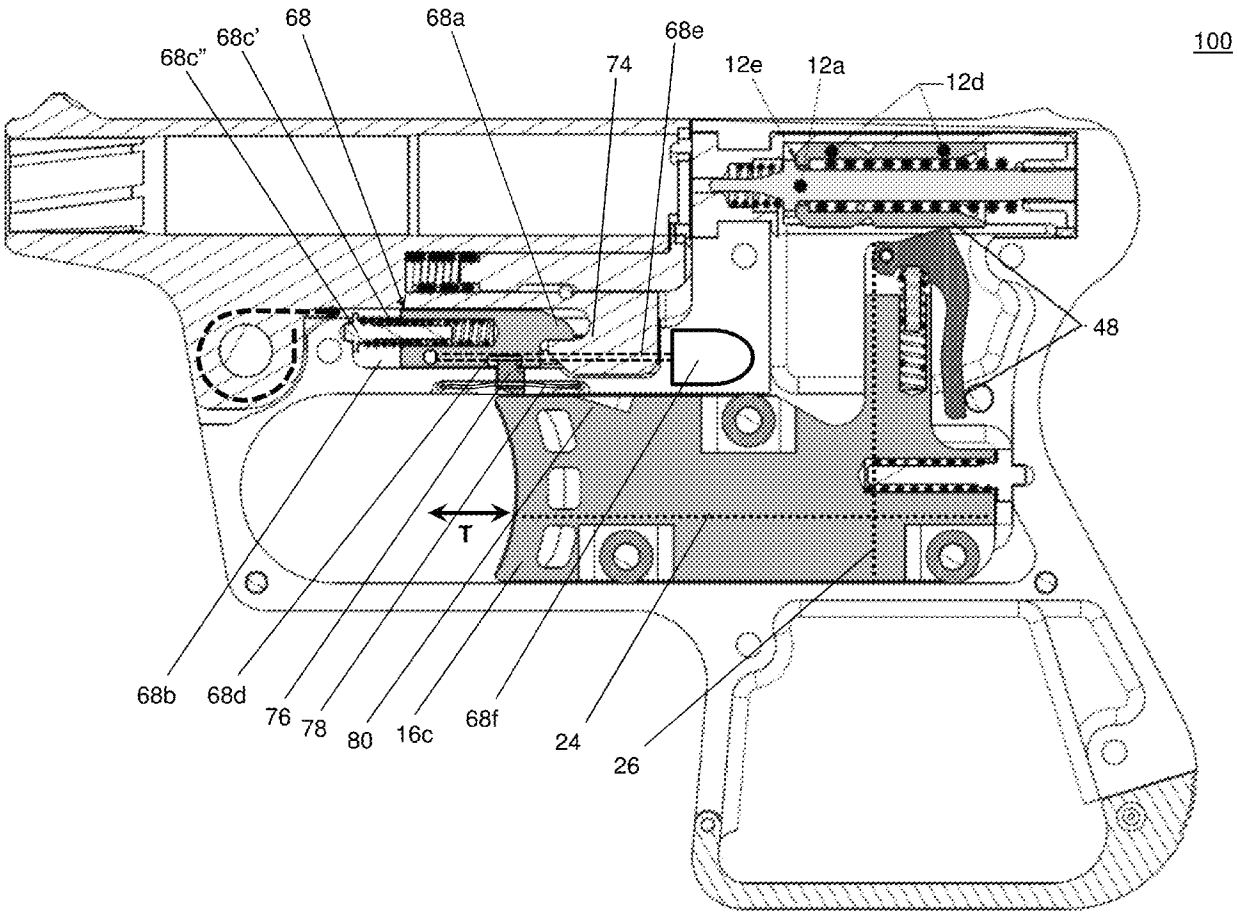
Figure 3D:
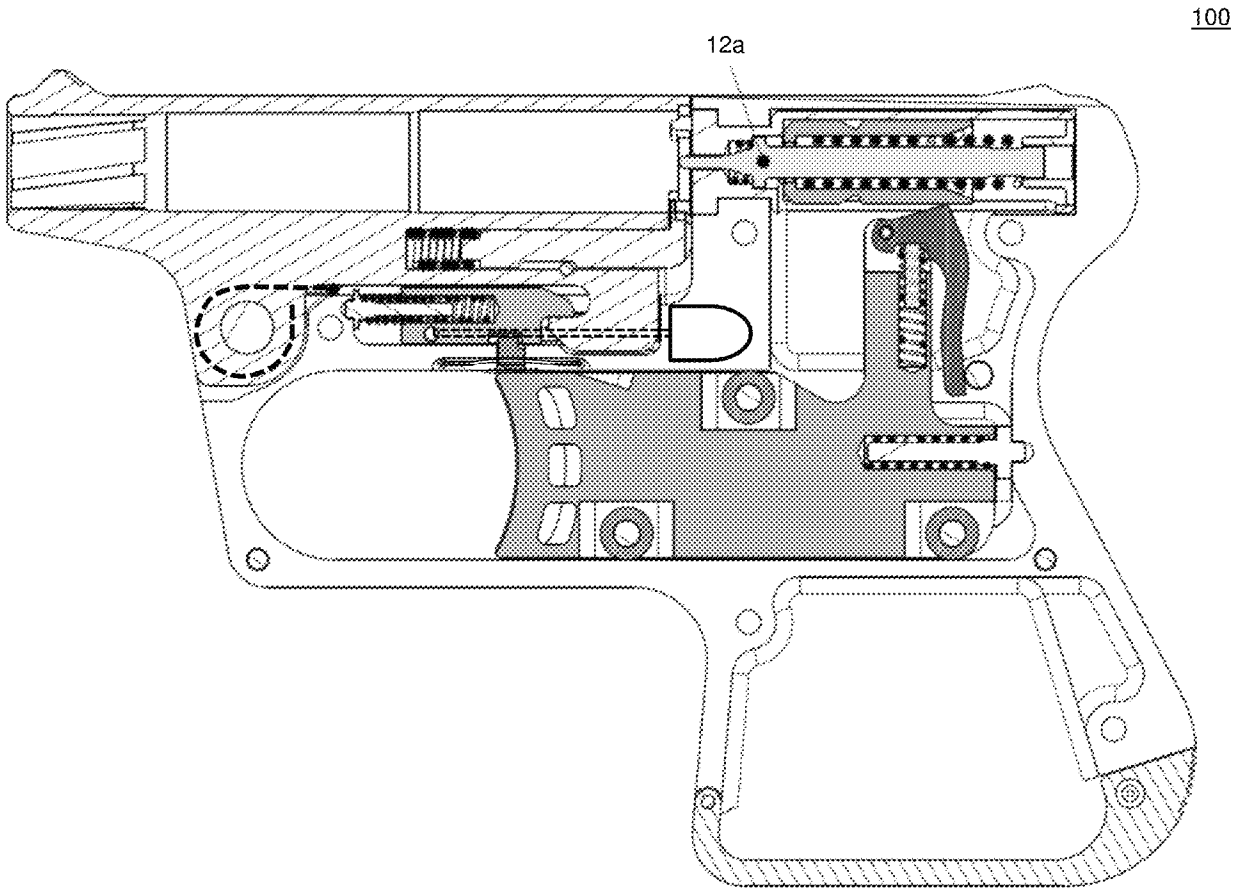
Figure 3E:
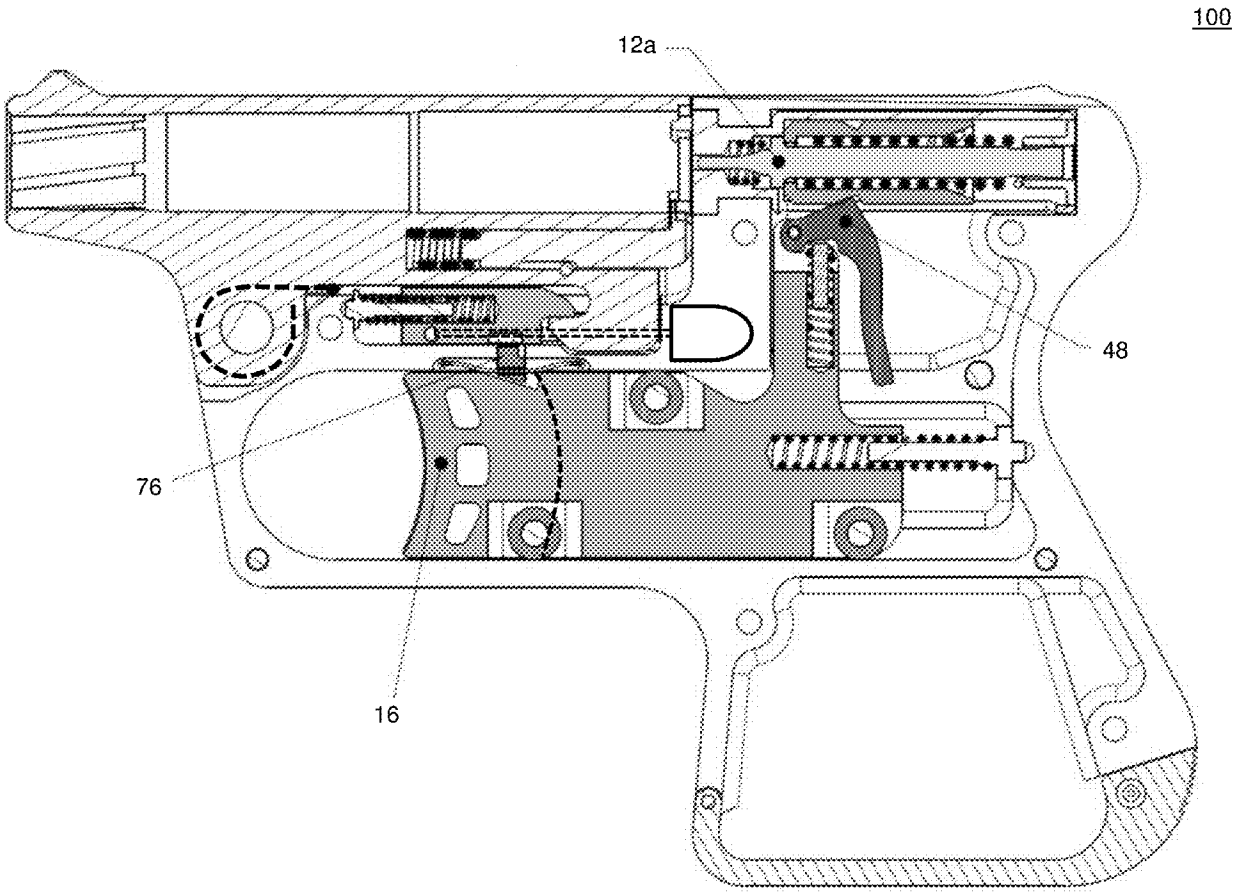

As illustrated in FIGS. 1, 3 and 4, the roller bearings can be positioned in the trigger pull within laterally-spaced upper and lower cavities 40*a*, 40*b* that are respectively open at the top side 22*d* and bottom side 22*e* of the trigger pull so that the bearings can engage and roll along fixed surfaces 42 adjacent to the top and bottom of the trigger pull. The fixed surfaces are preferably the upper and lower sides of the frame that enclose the trigger pull. In these embodiments, the roller bearings 28 are connected to the trigger pull, i.e., trigger-mounted roller bearings 28', such as through a spindle 44, and they move with the trigger pull 22 relative to the frame's upper and lower surfaces 42*a*, 42*b* which surround the trigger pull and serve as the track for the roller bearings. As illustrated in FIGS. 2A and 2B, the roller bearings 28 may alternatively be positioned within laterally-spaced upper and lower elongated slots 46*a*, 46*b* formed in the trigger pull. In this alternative embodiment, the roller bearings are connected to the frame's side faces 10*d*, i.e., frame-mounted roller bearings 28", such as through the bearing spindles 44, and rotate while fixed in place relative to the frame while the trigger pull and slots move relative thereto. The outer surface of the bearings preferably engages only one of the surfaces in their respective slots, top or bottom, which serve as the tracks 38 for the roller bearings.

It will be appreciated that is possible to use the trigger-mounted roller bearing configuration and frame-mounted roller bearing configuration within the same trigger pull, such as shown in FIG. 1A. In this arrangement, the frame-mounted roller bearing is in the upper portion of the trigger and the trigger-mounted roller bearing is in the lower portion. It will be appreciated that these positions could be switched. When only the trigger-mounted roller bearing is used, it is preferable to include two bearings in longitudinally spaced cavities on either the top or bottom of the trigger pull to avoid potential rocking and premature wear of the trigger pull. The roller bearing can be a ball bearing assembly, a plastic bearing wheel assembly, a needle rolling bearing assembly, a caster bearing assembly or other similar bearings. A combination of different bearings could be used in the same trigger pull, such using a DELRIN bearing wheel and ball bearing combination.

The sequence of illustrations in FIGS. 2A and 2B and FIGS. 3A-3E shows how the trigger assembly 16 operates the firing assembly 12 with a resting position 16*a*, a cocked position 16*b*, and a firing position 16*c*. These illustrations also show how the trigger pull operates the safety locking mechanism to force it into engagement with the barrel latch assembly 68 when the trigger pull is moved from the resting position to the firing position as described in more detail in the safety locking mechanism section below. The trigger assembly is preferably connected to the pivoting portion 48*a* of a sear 48 through a pivot pin 50. The trigger assembly has a bore 52 that is transverse to a section 48*b* of the sear that extends from the pivoting portion. A sear engagement spring 54 and pin 56 fit within the transverse bore. The sear spring forces the distal end of the pin outward from the opening of the transverse bore toward the sear section and bias the sear section into an engagement with the linear firing system. The trigger assembly also includes a bore 58 which is aligned with the longitudinal axis of the elongated trigger pull. A trigger return spring 34*a* and a distal end 34*b*' of a pin 34*b* fit within the bore. The proximal end 34*b*" of the pin is connected to the frame, and the spring biases the trigger pull to its rest position. The sear also has a distal end 48*c* that engages a disconnect protrusion 60 which may be shaft, tab, pin, or other extension in the frame when the firing assembly is moved to its cocked position.

In the firing-ready position and orientation of the trigger assembly, sear assembly and firing assembly, the trigger assembly engages the firing assembly through the sear and thereby moves the firing assembly from its resting position to the cocked position as the trigger pull is depressed from its rest position to its firing-ready retracted position. As indicated above, the sear engages the disconnect when the firing assembly is at the cocked position, and as the trigger assembly forces the sear further, the engagement between the sear and the disconnect forces the sear to rotate around its pivot against the sear spring force that biases the sear section into engagement with the firing assembly and causes the sear section to disengage from the firing assembly. When the trigger finger force is removed from the trigger pull, the trigger return spring and sear engagement spring respectively bias the trigger pull and the sear assembly back to their rest position where the sear section is biased back into engagement with the firing assembly.

The linear firing system 62 preferably includes the elongated firing pin assembly 12, an axial spring 64, and a housing 66. The firing pin assembly 12 includes the firing pin 12*a* and a reset spring 12*b* and has a longitudinal axis 12*c* that extends between its striking end and butt end. In the embodiment shown in FIG. 1, the firing pin has an indent between the striking end and the butt end, and the indent can be a circumferential groove around the firing pin. In the embodiment shown in FIG. 2, the firing pin has a tab between the striking end and the butt end. The tab extends from the firing pin substantially perpendicular to the longitudinal axis, and the butt end has an outer diameter that is substantially wider than a diameter of the striking end. The axial spring has one end pressed against the outer diameter of the butt end and forces the firing pin from its cocked position to its firing position. The embodiment shown in FIGS. 3 and 4 has a preloaded linear firing system.

In the preloaded linear firing system embodiment, the firing pin assembly has a reset spring 12*b* and an outer slider sleeve 12*d* or inertia piston that surrounds an internal firing pin 12*a*. As with the embodiments described above, the firing pin is biased back from the front face of the housing by the reset spring, and the forward movement of the firing pin is limited by a circumferential rim 12*e* in the pin that engages a step in the internal surface of the housing at the pin's forward-most position. The slider translates within the housing and is spring-loaded to push to a forward lip in the housing that is engaged by the front of the slider. The slider's forward-most position is limited by the lip that is separate from the step which limits the pin's forward-most position. Accordingly, the slider can be pre-loaded by its axial spring to its forward-most position while the pin is biased back from the front face away from its forward-most position. In comparison, for the embodiments described above with reference to FIGS. 1 and 2, the firing pin has a sliding element fixedly connected to the pin portion so the firing pin assembly is a single piece and there is no preloading of the firing pin.

As the sear engages the catch in the slider and draws the slider back from the lip, the pin's spring pushes the pin's rim further back into the housing past the lip. When the sear releases the slider, the slider spring forces the slider back to its forward-most position. The front of the slider impacts the backside of the pin's rim, transferring the kinetic energy of the slider to the pin and forcing the pin to its forward-most position with a force sufficient to cause the primer's ignition for the cartridge in the firing chamber. There is a space between the front of the slider and the backside of the pin's rim when both the slider and the pin are in their forward-most position. Accordingly, after the slider forces the pin forward to impact the cartridge, the pin spring biases the pin back into the housing within the hole in the housing's front face. The pin's rim is pushed back until the backside of the rim is flush against the front of the slider which is spring-biased to its forward-most position at the lip.

Although the trigger assembly is shown as it is integrated into a pistol, it will be appreciated that the trigger of the present invention can be used for different types of firearms, particularly including breech-loading pistols, shotguns and rifles. Additionally, the unique features and arrangements of the trigger's bearing track system could be used in the trigger assemblies of firearms other than breech-loading firearms.

Trigger-Actuated Safety Locking Mechanism for Barrel Latch

Another aspect of the present invention is the safety locking mechanism 18 for a spring-loaded barrel latch assembly 68 which is mounted to the frame and holds the barrel assembly 14 in its closed firing position. One end of the barrel assembly is rotatably connected to a mount 70 on the frame through a hinge or other type of pivot joint 72, such as with a takedown pin that extends through a bore extending across a pair of shoulders in the frame and a flange extending down from the barrel between the shoulders, and the breech end 14*a* of the barrel assembly can rotate around the pinned connection between an open loading position and a closed firing position. The barrel latch assembly holds the barrel assembly to the frame in the firing position by a catching engagement between the frame's barrel latch 68*a* and a catch that is connected to the barrel, such as a hook 74 on the bottom of the barrel. It will be appreciated that other catches could be used in place of a hook. The barrel latch safety locking mechanism prevents the frame's barrel latch from disengaging away from the barrel's hook while the firearm is being discharged, thereby maintaining the barrel in its closed firing position during the discharge of the ammunition and preventing an untimely opening of the barrel assembly.

The barrel latch assembly 68 includes the barrel latch 68*a*, a recess 68*b* in the frame in which the barrel latch is seated, a helical coil spring 68*c*' surrounding a spring pin 68*c*", a notch 68*d* in the bottom of the barrel latch, and a slide switch 68*e* connected to the barrel latch through an elongated rod 68*f*. The spring pin is secured to the frame at a proximal end and extends into a bore hole in the barrel latch at a distal end. The spring biases the barrel latch in an extended position toward the barrel's hook. The slide switch and rod serve as a stop mechanism which prevents the spring from overextending and pushing the barrel latch's bore hole off of the spring pin. The slide switch also serves as an actuator to disengage the barrel's hook from the frame's barrel latch so that the barrel assembly can rotate around a takedown pin into its open position. The barrel latch safety locking mechanism prevents the slide switch from accidentally being actuated when the trigger pull is depressed, moving from its rest position to its retracted position and the firearm is being discharged. The safety locking mechanism also prevents the barrel latch from being jerked away from its engagement with the hook due to the recoil of the firearm being discharged. Accordingly, when the trigger pull is in its rest position, a person can actuate the slide switch to push the barrel latch back, thereby releasing the hook and opening the barrel assembly. When the slide switch is moved in a longitudinal direction opposite to the spring biased extended position of the barrel latch, the latch moves back away from the barrel's hook, and the barrel is then free to rotate from the firing position to the loading position. However, when the trigger pull is in its retracted firing-ready position, the barrel latch safety locking mechanism 18 locks the barrel latch 68*a* as it is engaged with the barrel catch so that the latch cannot release the barrel catch during discharge of the firearm.

The barrel latch safety locking mechanism 18 includes a locking pin, tab or other projection 76 that fits into the notch 68*d* in the bottom surface of the barrel latch. When the locking pin is positioned within the notch, the pin prevents the latch from moving back away from the barrel's hook 74 or other catch. The safety locking mechanism also preferably includes a spring 78 and a ramp 80. In the preferred embodiment, a leaf spring connects the locking pin to the frame and biases the locking pin toward the top of the trigger pull, and the ramp is formed into the top surface of the trigger pull. It will also be appreciated that the spring could alternatively be connected to the trigger pull to bias the locking pin toward the barrel latch which could have a ramped surface in the notch.

As indicated above, one of the primary benefits of the barrel latch safety locking mechanism is that it prevents the barrel from opening to the loading position from the firing position while the firearm is being discharged by preventing accidental actuation of the slide switch and preventing inertial motions of the firearm during discharge from jerking the barrel latch away from the hook. Additionally, the safety locking mechanism according to the present invention is particularly beneficial because it is actuated by the trigger pull so that the locking pin engages and secures the barrel latch in its biased engaged position with the hook as the trigger pull is retracted and the firearm is discharged. The spring-biased locking pin automatically disengages from the barrel latch and frees the slide switch when the trigger pull is in the rest position. Since the barrel latch remains in its biased engaged position with the barrel hook even when the locking pin is disengaged, a positive actuation of the slide switch while the trigger is in its resting position is also required to disengage the slide switch from the hook. Accordingly, barrel latch can only be disengaged from the hook on the bottom of the barrel when the trigger pull is in its rest position and the locking pin is disengaged from the notch in the bottom of the barrel latch.

The operation of the barrel latch safety locking mechanism is particularly illustrated in FIGS. 3A-3E. As the trigger pull is actuated and translates rearward, the ramp in the top surface of the trigger pushes the locking pin upward against the biasing force of the leaf spring into the notch (see FIGS. 3A-3D). When the trigger pull is released and is biased back to its rest position by the trigger spring, the leaf spring biases the locking pin downward out of the notch (see FIG. 3E), and as indicated above while the locking pin is in this downward biased position, the trigger must be in the rest position and the barrel can be opened.

Extractor Assembly for Rimless Shells in Breech-Load Barrel

As shown in FIGS. 4 and 5, an innovative extractor assembly 20 for rimless shells 110 that are fitted into the firing chambers 14*b* of breech loading firearms can also be incorporated into the barrel design. Aspects of the present invention can be used for non-tapered rimless shells 110, and the inventive aspects are most advantageous when used with tapered rimless shells. A standard extractor assembly for rimmed cartridges is shown in FIG. 3. The rimless extractor assembly of the present invention is shown in FIGS. 4 and 5 and has an extractor arm 82 with a proximal end 82*a*, a longitudinally extending elongated section 82*b* and a laterally extending projection 82*c* at a distal end. The extractor arm fits within a cavity 84 that extends longitudinally into the barrel assembly 14 between the barrel's firing chamber and the hook 74 at the bottom of the barrel. The extractor arm is biased out toward the opening 84*a* of the cavity by a spring-loaded guide 94 which is fitted between the proximal end of the extractor arm and the internal end 84*b* of the cavity and which engages the proximal end of the extractor arm.

The extractor arm's elongated section has an indentation 86 extending along one side which is situated over a spring pin, tab or other stop 88 that is fixed within the cavity. The spring pin engages the inner end of the indentation to prevent the extractor arm from being ejected out of the cavity. The outer end of the indentation remains within the cavity when the inner end reaches the stop thereby limiting the extractor arm to its fully extended position. Accordingly, the length of the indentation from the inner end to its outer end is at least the distance of travel of the extractor arm from its contracted position to its extended position and is less than the distance from the spring pin to the opening of the cavity. The thickness ($t_s$) of the extractor arm is slightly smaller than the size of the cavity so that when the cartridge is fully seated in the chamber, the extractor arm fits snugly in the cavity but it is not too tight so that binding within the cavity is prevented and the helical coil spring and guide can push the extractor out until the inner end of the indentation reaches the stop.

As particularly shown in FIGS. 5A-5D, the extractor arm for the rimless extractor assembly has the standard thickness ($t_s$) at its distal end which, as described above, is slightly smaller than the size of the cavity. This snug fit between the distal end and the cavity opening allows the projection on the arm to securely hold the base portion of the shell which extends out from the firing chamber when the cartridge is fully seated in the chamber and the extractor arm is in its contracted position. The intermediate section of the extractor arm, between the distal end of the extractor arm and the outer end of the indentation, has a reduced thickness ($t_r$) which is more narrow than the thickness of the arm at its distal end (i.e., $t_r<t_s$). The reduction in the thickness of the intermediate section can be on both sides of the arm, but is at least provided on the side of the arm that is opposite from the cartridge in the firing chamber which provides a space between the intermediate section and the cavity walls which permits the arm and its projection to have a slight rotation 90 within the cavity away from the chamber and the cartridge as the tapered shell is being inserted and removed from the firing chamber as particularly shown in FIG. 5B.

It will be appreciated that as the extractor arm rotates within the cavity, the entire extractor arm rotates so that it does not bend. The inner face 82*d* of the extractor arm's proximal end that is engaged by the spring-loaded guide is preferably angled relative to the arm's direction of travel along its longitudinal axis such that the inner face is angled toward the firing chamber. This angled inner face is beneficial in allowing the entire extractor arm to rotate within the cavity without rotation because it prevents the proximal end of the arm closest to the chamber from digging into the cavity wall as the arm rotates within the cavity. It will be appreciated that this angle could also be provided with a rounded inner face, a tapered proximal end, or with some other type of reduction in the thickness at the proximal end, particularly on the side of the extractor arm facing towards the firing chamber. If there were no reduction in the thickness at the proximal end, when the distal end of the extractor arm is rotated away from the firing chamber, a torque could result which may bend the extractor arm. Accordingly, the reduction in the thickness prevents the torque and potential for bending of the arm. The engagement between the spring-loaded guide and the angled inner face also provides a small moment arm in the direction of the arm's rotation away from the chamber.

The opening to the cavity may have a bevel 92 which helps guide the arm into the cavity and also helps prevent the arm from binding around a sharp corner at the opening, particularly when the narrowed intermediate section has a step reduction in thickness. It will be appreciated that rather than using a step reduction, the arm could be tapered from the standard thickness at a location on the arm proximate to the distal end to the outermost end of the intermediate section which is the location on the arm at the cavity opening when the arm is fully extended so that the inner end of the indentation is at the stop. An example of a tapered arm is shown by the dashed line between the $t_r$ demarcation and the $i_s$ demarcation in FIG. 5C.

Figure 5A:
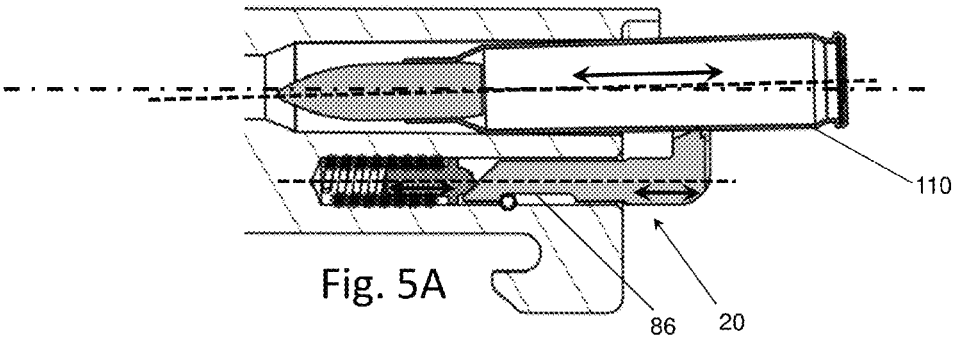
FIGS. 5A-5D are detail cross-sectional views of the rimless cartridge extractor shown in FIGS. 4A-4E.
Figure 5B:
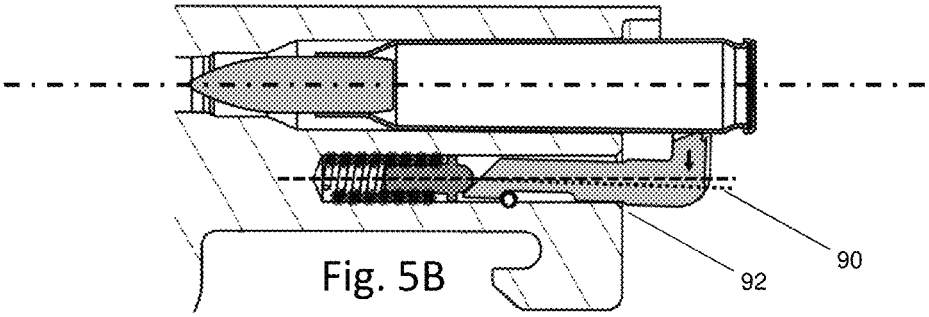
Figure 5C:
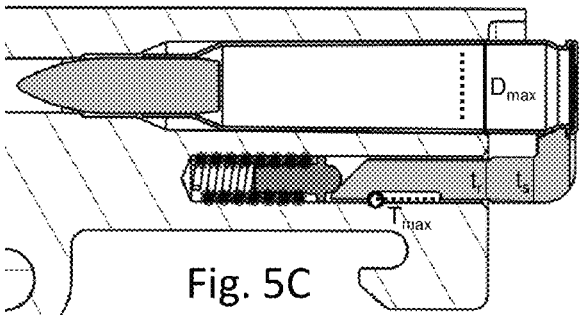

The position and orientation of the extractor arm are shown in FIGS. 5A-5D relative to the firing chamber and a tapered shell during the insertion and removal steps. In FIGS. 5A-5C, the arm is at its fully extended position, and in FIG. 5D, the arm is in its fully contracted position. FIG.

Figure 5D:
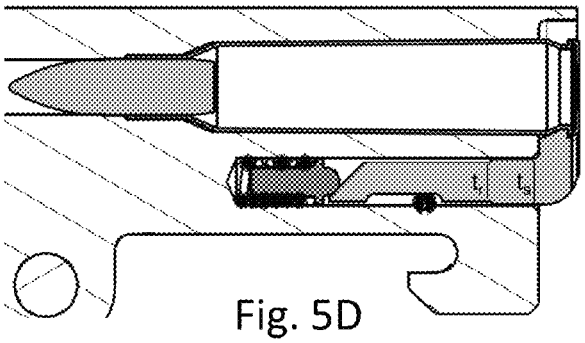

5A shows the shell as it is being initially inserted or withdrawn completely from the firing chamber, and in this position, the longitudinal axis of a tapered shell may have an acute angle relative to the chamber's longitudinal axis which is directly in-line with the arm, i.e., the longitudinal axes are parallel to each other. FIG. 5B shows the shell as it continues to enter the chamber just before the tip of the arm's projection engages the shell's cannelure, or just after the cannelure disengages from the tip as the shell is withdrawn from the chamber. In this position, the distal end of the arm is rotated away from the shell so that the tip of the projection which fits into the cannelure can clear the shell casing. It will be appreciated that in this position, the chamber's bottom sidewall constrains the shell casing from an acute angle that would have been necessary to clear the tip of the arm's projection if the arm had the standard thickness and could not rotate which would thereby cause an interference between the casing and the tip of the projection. FIG. 5C shows the shell as its cannelure is engaged with the tip of the arm's projection while the arm is in its fully extended position. FIG. 5D shows the shell as its cannelure is engaged with the tip of the arm's projection while the arm is in its fully contracted position.

It will be appreciated that the length of the arm could be increased so that the rotation of the arm away from the casing is not required. Instead, the tip of the arm's projection would engage the cannelure when the shell is rotated at its acute angle so that there is no interference between the casing and the projection's tip. However, this would require an arm that is long enough for its distal end to extend much further past the opening of the cavity than is required by the design of the present invention so that the tip could engage the cannelure while the shell remain in its acute angle, i.e., a length which would span the distance between the opening and the cannelure as shown in FIG. 5A. In such an alternative design, the arm would need to be pushed into the cavity from its fully extended position while the barrel is being closed and before the top of the frame interferes with the distal end of the arm. If a person attempts to close the barrel without pushing the arm into the cavity, the arm could get bent or otherwise damaged, and if a cartridge is in the chamber during this closure, the casing could also damaged and may cause the shell to be lodged in the chamber when it is fully seated which would prevent the spring force of the arm from being able to extract the cartridge and would require additional force applied to the base of the shell and/or the arm's distal end. Instead, according to the present invention, the extractor arm has a maximum travel distance ($T_{max}$) that is less than the firing chamber's maximum diameter ($D_{max}$). The extractor arm's rotation allows for loading long cartridges with an extractor arm that longitudinally slides the short travel distance which is beneficial because it prevents the extractor arm from being bent or otherwise damaged when the barrel is being closed. In fact, the travel distance is short enough that the extractor arm obliquely engages the wall of the breech plate which pushes the extractor arm inwardly into the cavity as the barrel is being closed.

Figure 4A:
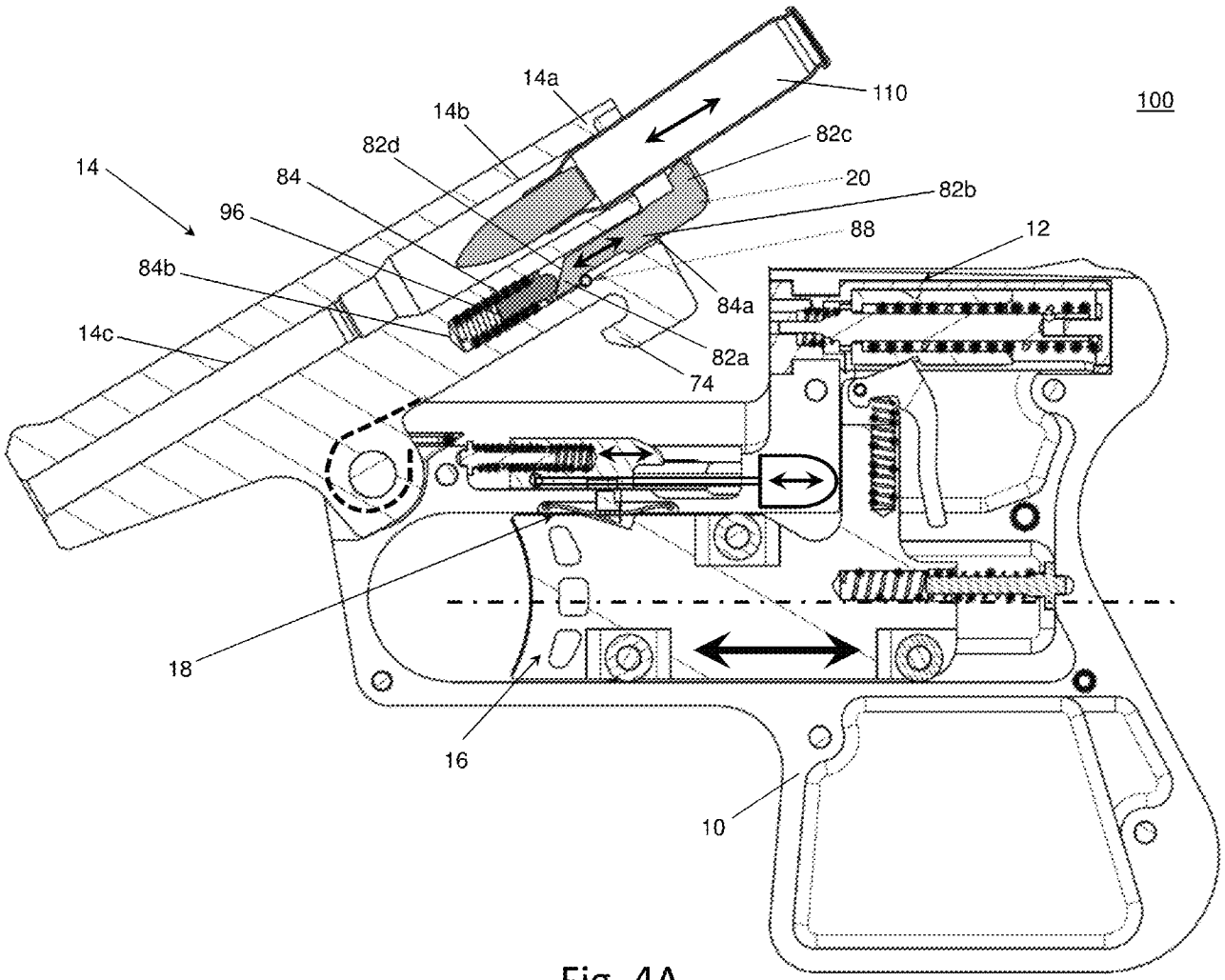
FIGS. 4A-4E are cross-sectional views of the elongated trigger assembly with an alternative barrel in a progression through open-barrel cartridge loading, closed-barrel latching and cartridge discharge, and open-barrel cartridge extracting and return to loading.
Figure 4B:
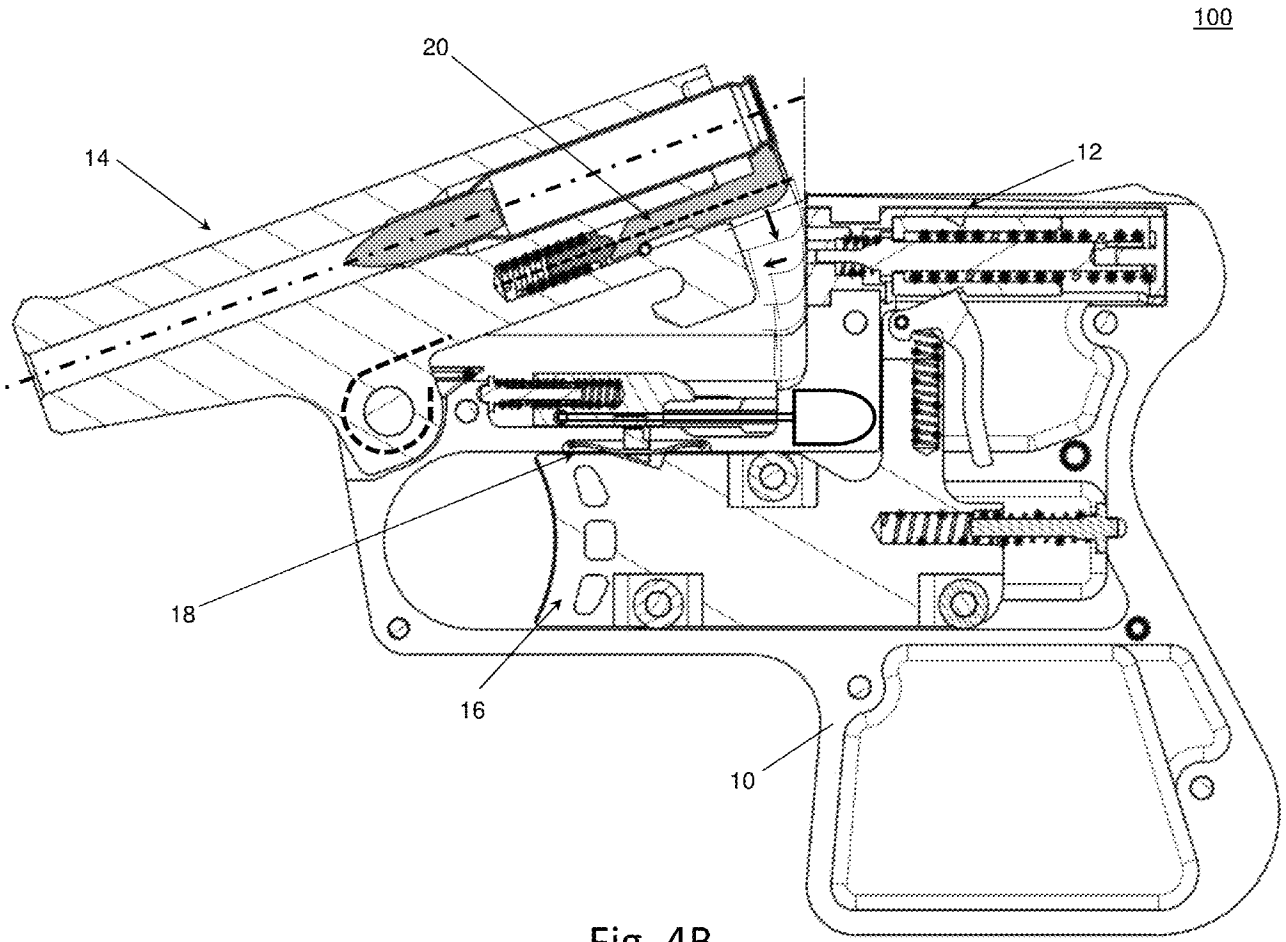
Figure 4C:
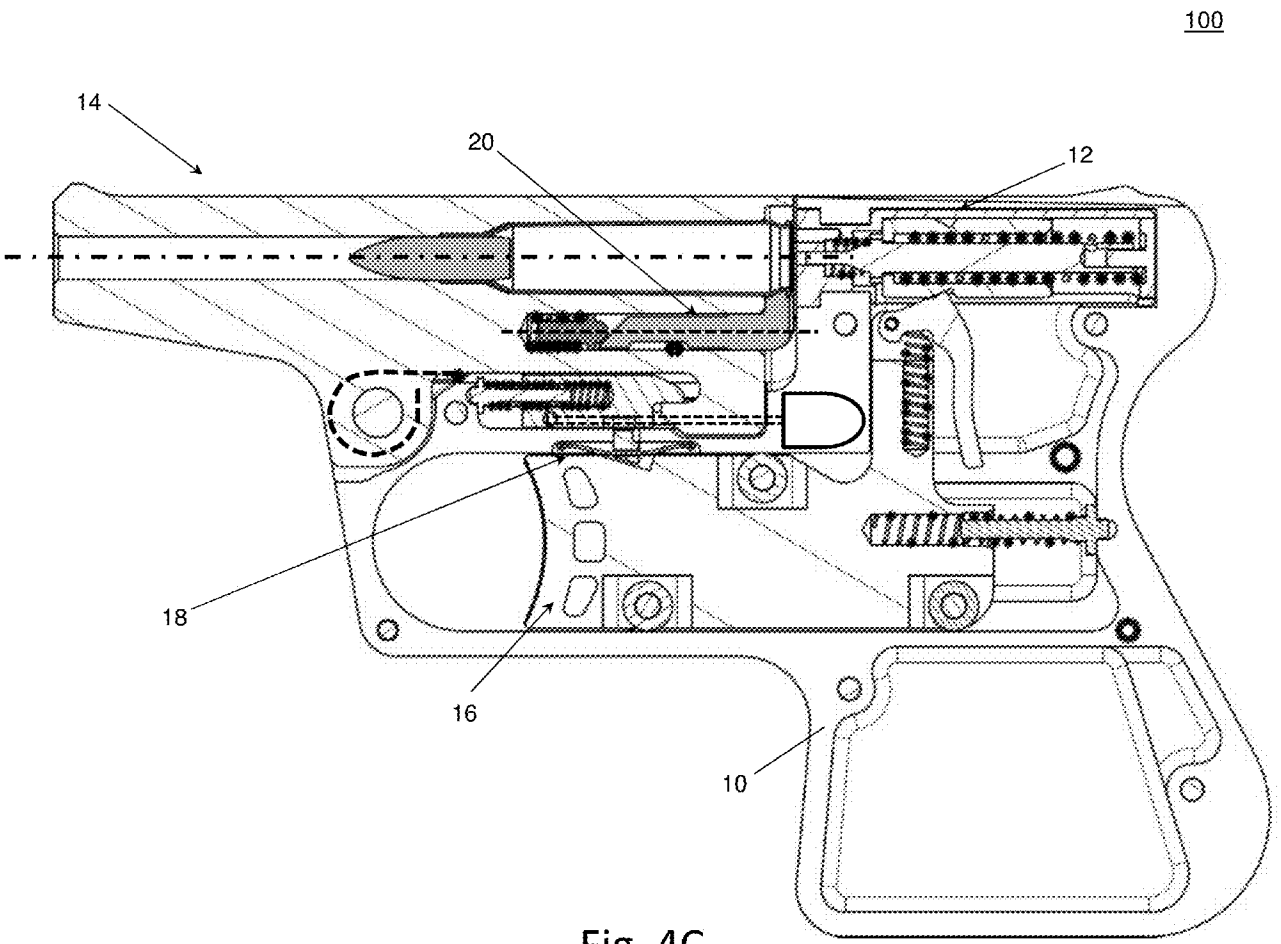
Figure 4D:
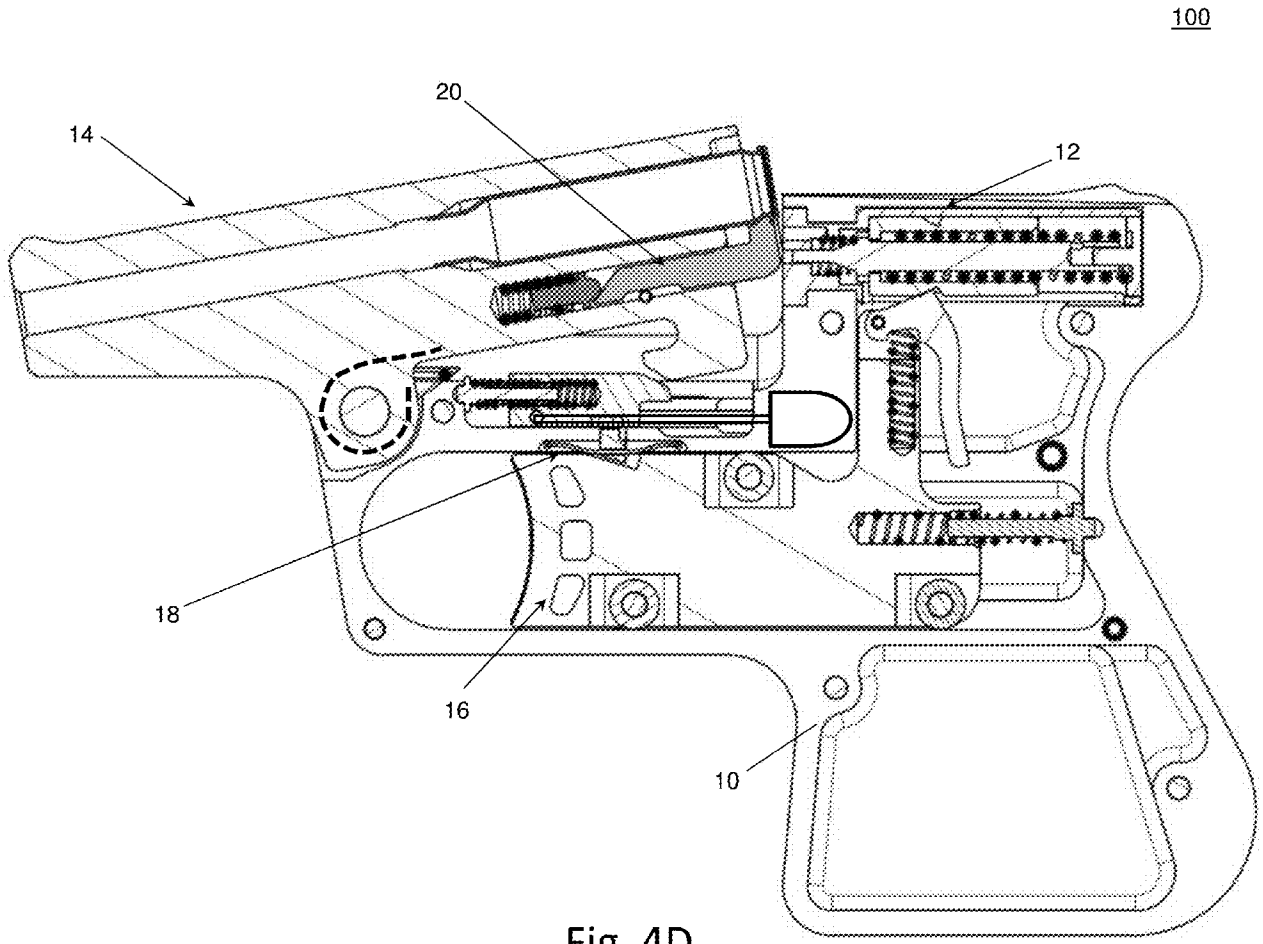
Figure 4E:
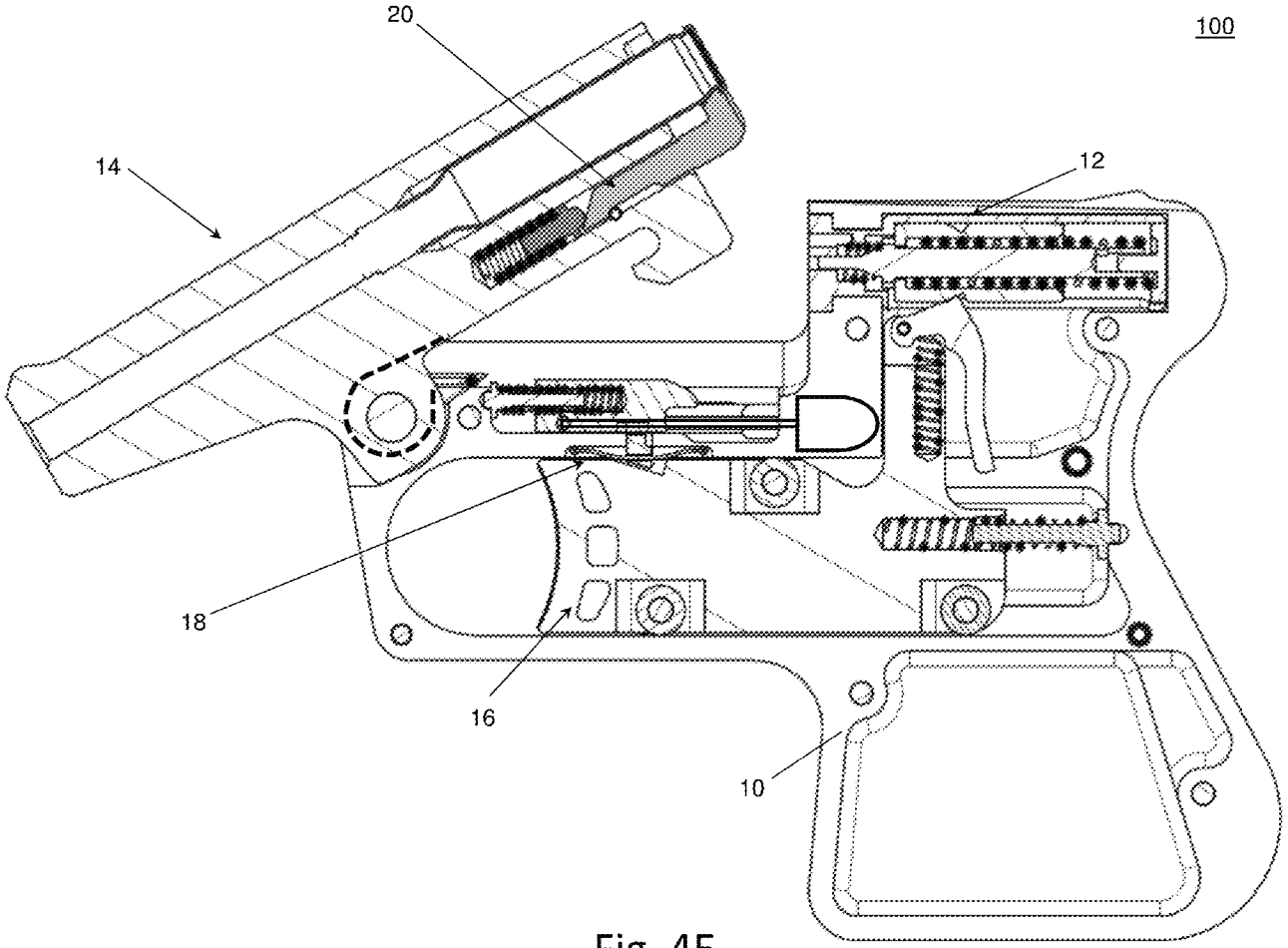

Instead of using such a long arm, the present invention uses a much shorter arm which can rotate away from the longitudinal axis of the firing chamber and the shell's casing. The shorter arm is designed such that at its fully extended position, the length of the arm's distal end which extends out from the opening to the cavity is less than the distance between the opening to the firearm's breech plate and/or frame, such as shown by the dashed lines in FIG. 4B. With the inventive design, the arm can remain in its fully extended position while the barrel is being closed. The person does not need to begin pushing in the arm before closing the barrel; instead, as the barrel assembly is being closed and the endmost surface of the arm's distal end engages the opposing surface of the frame and/or breech plate at an acute angle so that the opposing surface forces the arm to retract into the cavity against the opposing force of the helical coil spring. As the opposing surface pushes the arm further into the cavity, the arm pushes the shell further into the firing chamber by the engagement between the projection and the cannelure until the shell is fully seated in the chamber, the arm is in its corresponding contracted position and the barrel assembly is locked in place by the engagement between the hook and barrel latch. The endmost surface of the arm's distal end is preferably rounded to provide a tangential engagement between the endmost surface and the opposing surface of the frame and/or breech plate as the barrel assembly is being closed. The tangential engagement is shown in FIG. 4B by the dotted phantom lines which represent the arm and breech side face of the barrel hook as the barrel assembly is closed and the arm is pushed into the cavity.

As illustrated in the various figures, different caliber barrels 14*c* can be fitted to the firearm frame 10. Additionally, various aspects of the present invention are applicable to single barrel firearms and multiple barrel firearms. The barrel assembly is preferably connected to the frame through a takedown pin and is biased to the open position by a spring, such as with a torsion coil spring.

The embodiments were chosen and described to best explain the principles of the invention and its practical application to persons who are skilled in the art. Various modifications could be made to the exemplary embodiments without departing from the scope of the invention, and it is intended that all matter contained herein shall be interpreted as illustrative rather than limiting. For example, although the trigger assemblies of the present invention are shown in a pistol, it will be appreciated that the invention could also be used in other types of firearms, particularly including a shotgun and a rifle. Also, although the barrel latch safety locking mechanism is actuated by a reciprocating trigger according to the embodiments described herein, firearms with a rotating trigger could use the barrel latch safety locking mechanism according to the present invention and without departing from the scope of the invention are recited in the claims directed particularly to this aspect of the invention. Thus, the breadth and scope of the present invention is not limited by the above-described embodiments but is defined in accordance with the following claims appended hereto and their equivalents.

What is claimed is:

1. A barrel assembly for a firearm, comprising:

a barrel with a firing chamber at a proximal end of the barrel, wherein the barrel and the firing chamber have a longitudinal axis;

a cavity adjacent to and aligned with the longitudinal axis of the firing chamber and the barrel, wherein the cavity extends from an internal end to an open end; and an extractor arm slidingly arranged within the cavity, wherein the extractor arm is comprised of a proximal end, an elongated section, and a distal end with a lateral projection, wherein the lateral projection extends toward the longitudinal axis of the firing chamber and the barrel, wherein the extractor arm has a retracted position and an extended position, wherein the elongated section extends past the open end of the cavity, wherein the extractor arm is constrained from rotating when in the retracted position, wherein the elongated section has at least one degree of rotational freedom in the cavity without bending when the extractor arm is in the extended position, wherein the distal end and lateral projection rotate away from the firing chamber when the extractor arm is in the extended position, wherein the extractor arm has a first thickness in an intermediate portion of the elongated section and a second thickness of the elongated section proximate to the distal end, wherein the second thickness is greater than the first thickness, wherein the second thickness fits within the cavity when the extractor arm is in its retracted position, and wherein the first thickness provides a space between the extractor arm and a wall of the cavity when the extractor arm is in its extended position to provide for the rotation of the extractor arm within the cavity in its extended position.

2. The barrel assembly of claim 1, wherein the proximal end of the extractor arm has an inner face angled toward the firing chamber.

3. The barrel assembly of claim 2, further comprising a spring-loaded guide and a stop, wherein the spring-loaded guide is situated between an internal end of the cavity and the proximal end of the extractor arm, wherein the inner face engages with the spring-loaded guide, wherein the extractor arm is biased out toward the open end of the cavity by the spring-loaded guide, wherein the stop is fixed within the cavity, and wherein the stop engages the extractor arm and prevents the proximal end of the extractor arm from being ejected out of the cavity.

4. The firearm of claim 1, wherein a maximum travel distance of the extractor arm is less than a maximum diameter of the firing chamber.

5. The barrel assembly of claim 1, further comprising a hook extending from the proximal end of the barrel, wherein the cavity is situated between the hook and the firing chamber, and wherein the hook engages a latch connected to a frame of the firearm.

6. The barrel assembly of claim 5, further comprising a trigger assembly fitted within the frame of the firearm, wherein the trigger assembly is comprised of an elongated trigger pull having a longitudinal axis extending between a front of a trigger shoe and a back surface of the elongated trigger pull, an upper portion above a centerline, and a lower portion below the centerline, a first set of trigger tracks within the frame, a second set of trigger tracks within the frame, a first set of roller bearings engaging the first set of trigger tracks, and a second set of roller bearings engaging the second set of trigger tracks, wherein the first set of roller bearings is positioned in the upper portion of the elongated trigger pull and wherein the second set of roller bearings is positioned in the lower portion of the elongated trigger pull.

7. The barrel assembly of claim 5, wherein the frame further comprises a barrel latch safety locking mechanism, wherein the barrel latch safety locking mechanism is comprised of a barrel latch having a notch and a locking pin fitting within the notch, wherein the elongated trigger pull pushes the locking pin into the notch while the elongated trigger pull is depressed from a rest position to a retracted position.

8. A firearm, comprising:

a frame;

a firing assembly situated within the frame;

a barrel assembly connected to the frame and in operative communication with the firing assembly, wherein the barrel assembly is comprised of a barrel, a firing chamber, and a cavity, wherein the cavity is adjacent to and aligned with a longitudinal axis of the firing chamber and the barrel; and an extractor arm slidingly arranged within the cavity, wherein the extractor arm is comprised of a proximal end, an elongated section, and a distal end with a lateral projection, wherein the lateral projection extends toward the longitudinal axis of the firing chamber and the barrel, wherein the extractor arm has a retracted position and an extended position, wherein the elongated section extends past the open end of the cavity, wherein the extractor arm is constrained from rotating when in the retracted position, wherein the elongated section has at least one degree of rotational freedom in the cavity without bending when the extractor arm is in the extended position, and wherein the distal end and the lateral projection rotate away from the firing chamber when the extractor arm is in the extended position, wherein the extractor arm has a first thickness in an intermediate portion of the elongated section and a second thickness of the elongated section proximate to the distal end, wherein the second thickness is greater than the first thickness, wherein the second thickness fits within the cavil when the extractor arm is in its retracted position, and wherein the first thickness provides a space between the extractor arm and a wall of the cavity when the extractor arm is in its extended position to provide for the rotation of the extractor arm within the cavity in its extended position.

9. The firearm of claim 8, further comprising a spring-loaded guide and a stop, wherein the spring-loaded guide is situated between an internal end of the cavity and the proximal end of the extractor arm, wherein the proximal end of the extractor arm engages with the spring-loaded guide, wherein the extractor arm is biased out toward the open end of the cavity by the spring-loaded guide, wherein the stop is fixed within the cavity, and wherein the stop engages the extractor arm and prevents the proximal end of the extractor arm from being ejected out of the cavity.

10. The firearm of claim 9, wherein the proximal end of the extractor arm has an inner face angled toward the firing chamber.

11. The firearm of claim 8, wherein a maximum travel distance of the extractor arm is less than a maximum diameter of the firing chamber, wherein the barrel assembly rotates between an open position and a closed position, wherein the extractor arm obliquely engages the frame as the barrel assembly rotates from the open position to the closed position, and wherein the frame forces the extractor arm from its extended position to its retracted position as the barrel assembly rotates from the open position to the closed position.

12. The firearm of claim 8, further comprising a hook extending from the barrel, wherein the cavity is situated between the hook and the firing chamber, and wherein the hook engages a latch connected to the frame of the firearm.

13. The firearm of claim 12, further comprising a trigger assembly fitted within the frame of the firearm, wherein the trigger assembly is comprised of an elongated trigger pull having a longitudinal axis extending between a front of a trigger shoe and a back surface of the elongated trigger pull, an upper portion above a centerline, and a lower portion below the centerline, a first set of trigger tracks within the frame, a second set of trigger tracks within the frame, a first set of roller bearings engaging the first set of trigger tracks, and a second set of roller bearings engaging the second set of trigger tracks, wherein the first set of roller bearings is positioned in the upper portion of the elongated trigger pull and wherein the second set of roller bearings is positioned in the lower portion of the elongated trigger pull.

14. The firearm of claim 12, further comprising an elongated trigger pull situated within the frame and a barrel latch safety locking mechanism, wherein the barrel latch safety locking mechanism is comprised of a barrel latch having a notch and a locking pin fitting within the notch, wherein the elongated trigger pull pushes the locking pin into the notch while the elongated trigger pull is depressed from a rest position to a retracted position.

15. A firearm, comprising:

a frame comprising a barrel latch, a barrel mount, and a handle;

a firing assembly situated within the frame;

a trigger assembly operatively connected to the frame and the firing assembly, a barrel assembly connected to the frame and in operative communication with the firing assembly, wherein the barrel assembly is comprised of a barrel, a firing chamber, a cavity, a pivot joint, a hook extending from the barrel, wherein the barrel and firing chamber are in operative communication with the firing assembly, and wherein the cavity is adjacent to and aligned with a longitudinal axis of the firing chamber and the barrel; and an extractor arm slidingly arranged within the cavity, wherein the extractor arm is comprised of a proximal end, an elongated section, and a distal end with a lateral projection, wherein the lateral projection extends toward the longitudinal axis of the firing chamber and the barrel, wherein the extractor arm has a retracted position and an extended position, wherein the elongated section extends past the open end of the cavity, wherein the extractor arm is constrained from rotating when in the retracted position, wherein the elongated section has at least one degree of rotational freedom in the cavity without bending when the extractor arm is in the extended position, and wherein the distal end and the lateral projection rotate away from the firing chamber when the extractor arm is in the extended position.

16. The firearm of claim 15, further comprising a spring-loaded guide and a stop, wherein the spring-loaded guide is situated between an internal end of the cavity and the proximal end of the extractor arm, wherein the proximal end of the extractor arm engages with the spring-loaded guide, wherein the extractor arm is biased out toward the open end of the cavity by the spring-loaded guide, wherein the stop is fixed within the cavity, and wherein the stop engages the extractor arm and prevents the proximal end of the extractor arm from being ejected out of the cavity.

17. The firearm of claim 15, wherein the extractor arm has a first thickness in an intermediate portion of the elongated section and a second thickness of the elongated section proximate to the distal end, wherein the second thickness is greater than the first thickness, wherein the second thickness fits within the cavity when the extractor arm is in its retracted position, and wherein the first thickness provides a space between the extractor arm and a wall of the cavity when the extractor arm is in its extended position to provide for the rotation of the extractor arm within the cavity in its extended position.

18. The firearm of claim 15, wherein the proximal end of the extractor arm has an inner face angled toward the firing chamber, and wherein a total travel distance of the extractor arm is less than a maximum diameter of the firing chamber.

19. A firearm, comprising:

a frame;

a firing assembly situated within the frame;

a barrel assembly connected to the frame and in operative communication with the firing assembly, wherein the barrel assembly is comprised of a barrel, a firing chamber, and a cavity, wherein the cavity is adjacent to and aligned with a longitudinal axis of the firing chamber and the barrel; and an extractor arm slidingly arranged within the cavity, wherein the extractor arm is comprised of a proximal end, an elongated section, and a distal end with a lateral projection, wherein the lateral projection extends toward the longitudinal axis of the firing chamber and the barrel, wherein the extractor arm has a retracted position and an extended position, wherein the elongated section extends past the open end of the cavity, wherein the extractor arm is constrained from rotating when in the retracted position, wherein the elongated section has at least one degree of rotational freedom in the cavity without bending when the extractor arm is in the extended position, wherein the distal end and the lateral projection rotate away from the firing chamber when the extractor arm is in the extended position, wherein a maximum travel distance of the extractor arm is less than a maximum diameter of the firing chamber, wherein the barrel assembly rotates between an open position and a closed position, wherein the extractor arm obliquely engages the frame as the barrel assembly rotates from the open position to the closed position, and wherein the frame forces the extractor arm from its extended position to its retracted position as the barrel assembly rotates from the open position to the closed position.

20. The firearm of claim 19, further comprising a spring-loaded guide and a stop, wherein the spring-loaded guide is situated between an internal end of the cavity and the proximal end of the extractor arm, wherein the proximal end of the extractor arm engages with the spring-loaded guide, wherein the extractor arm is biased out toward the open end of the cavity by the spring-loaded guide, wherein the stop is fixed within the cavity, and wherein the stop engages the extractor arm and prevents the proximal end of the extractor arm from being ejected out of the cavity.

21. The firearm of claim 19, further comprising an elongated trigger pull situated within the frame and a barrel latch safety locking mechanism, wherein the barrel latch safety locking mechanism is comprised of a barrel latch having a notch and a locking pin fitting within the notch, wherein the elongated trigger pull pushes the locking pin into the notch while the elongated trigger pull is depressed from a rest position to a retracted position.

22. The firearm of claim 19, further comprising a hook extending from the barrel and a latch connected to the frame of the firearm, wherein the cavity is situated between the hook and the firing chamber, and wherein the hook engages the latch in the closed position.

* * * * *